US006052986A

United States Patent [19]

Hoffmann et al.

[11] Patent Number: 6,052,986

[45] Date of Patent: Apr. 25, 2000

[54] METHOD AND DEVICE FOR BURNING FUEL WITH AIR

[75] Inventors: Stefan Hoffmann, Mülheim an der Ruhr; Peter Berenbrink, Oberhausen; Hans Judith, Mülheim an der Ruhr, all of Germany

[73] Assignee: Siemens Aktiengesellschaft, Munich, Germany

[21] Appl. No.: 09/272,748

[22] Filed: Mar. 16, 1999

Related U.S. Application Data

[63] Continuation of application No. PCT/DE97/01881, Aug. 28, 1997.

[30] Foreign Application Priority Data

Sep. 16, 1996 [DE] Germany ..... 196 37 725

[51] Int. Cl.[7] ..... F02C 7/00

[52] U.S. Cl. ..... 60/39.06; 60/725; 431/114

[58] Field of Search ..... 60/39.06, 725, 60/746, 747; 431/1, 114

[56] References Cited

U.S. PATENT DOCUMENTS

| | | | |
|---|---|---|---|
| 5,343,693 | 9/1994 | Komatsu et al. . | |
| 5,644,918 | 7/1997 | Gulati et al. | 60/725 |
| 5,809,769 | 9/1998 | Richards et al. | 60/725 |
| 5,943,866 | 8/1999 | Lovett | 60/725 |

FOREIGN PATENT DOCUMENTS

| | | |
|---|---|---|
| 43 36 096 A1 | 5/1994 | Germany . |
| 42 41 729 A1 | 6/1994 | Germany . |
| 2 275 738 | 9/1994 | United Kingdom . |
| 2 288 010 | 10/1995 | United Kingdom . |

OTHER PUBLICATIONS

International Publication No. WO 93/10401 (Schetter), dated May 27, 1993.

"Combustion–Driven Oscillations in Industry" (Putnam), American Elsevier Publishing Company, Inc., New York, 1971, pp. 3 and 159–175.

"Research into the Excitation Mechanisms of Self–Starting Combustion Oscillations in a Combustion System for Liquid Fuel" (Herrmann et al.), VDI Reports, No. 1193, 1995, pp. 251–261.

"Active Instability Control as a Research Method for Self–Starting Combustion Instabilities" (Gleis et al.), VDI Reports, No. 765, 1989, pp. 645–657.

*Primary Examiner*—Louis J. Casaregola

*Attorney, Agent, or Firm*—Herbert L. Lerner; Laurence A. Greenberg; Werner H. Stemer

[57] ABSTRACT

A method and a device for burning fuel with air in a combustion chamber. The air is fed to the combustion chamber through at least one air inlet and the fuel is fed to the combustion chamber through a plurality of burners. Each burner has an associated delay time corresponding to a period of time after which an acoustic impulse in the combustion chamber causes a thermal impulse during combustion of the fuel fed through the burner. The feeding of the fuel through the burner is controlled in such a way that the delay times of the burners are substantially different from one another. The invention can be used on a combustion chamber of a gas turbine.

17 Claims, 3 Drawing Sheets

METHOD AND DEVICE FOR BURNING FUEL WITH AIR

CROSS-REFERENCE TO RELATED APPLICATION

This application is a continuation of copending International application No. PCT/DE97/01881, filed on Aug. 28, 1997, which designated the United States.

BACKGROUND OF THE INVENTION

FIELD OF THE INVENTION

The invention relates to a method of burning fuel with air in a combustion chamber, to which the air is fed through at least one air inlet and to which the fuel is fed through a plurality of burners, each burner having an associated delay time corresponding to a period of time after which an acoustic impulse in the combustion chamber causes a thermal impulse during combustion of the fuel fed through the burner. The invention also relates to a corresponding device for burning fuel with air.

International Patent Publication No. WO93/10401 discloses such a method and such a device.

The invention relates in particular to a method and a device of the type mentioned at the outset for use in a gas turbine. A gas turbine is a combination of a compressor for air, a combustion device including at least one combustion chamber for burning a fuel in the air while forming a flue gas, and a turbine in the actual sense for the expansion of the flue gas. The turbine may be multipart, that is it may include a plurality of turbine sections connected one behind the other, and the same applies to the compressor. The compressor is a turbo compressor, in particular. Within the limits of conventional practice, the turbine drives the compressor.

The invention is associated with the task of damping or avoiding acoustic oscillations in a combustion chamber. The oscillations are induced by the combustion and are known as "combustion oscillations".

In many combustion chambers, specifically both in combustion chambers of gas turbines and in combustion chambers of boiler furnaces, industrial furnaces or other plants, unstable operating states occur under certain conditions that are clearly defined by the relevant thermodynamic operating parameters such as air coefficient and thermal output. The operating states are characterized by correlated fluctuations in the heat production during the combustion and in the static pressure in the combustion chamber and/or in the plant parts disposed upstream and downstream of the latter. Those fluctuations manifest themselves as acoustic oscillations which are self-excited in the combustion chamber. In addition to an increased noise nuisance in the vicinity of the relevant plant, the acoustic oscillations cause increased mechanical and thermal stresses on the combustion chamber and other parts of the plant. The oscillations can definitely lead to complete or partial failure within a short time.

The increased use of premix burners in corresponding combustion chambers, which accompanies increasing demands for combustion at as low a level of pollution as possible, leads to an increased tendency to form combustion oscillations due to the higher reaction density achieved by a premix burner, the ignition, which depends on the chemical composition of the mixture to be burned to a greater extent than in a diffusion burner, and the convective delay time within the flame being formed, which delay time is reduced as compared with a diffusion burner.

A combustion oscillation is generally due to an interaction between the flow of the reaction partners discharging from the burner being used and the transformation of energy during the combustion. The interaction produces and maintains a stable acoustic oscillation in combination with an acoustic resonance appearing in the combustion chamber and adjoining plant parts. In that case, there is a closed effective circuit in a system which is capable of acoustic oscillations and is formed of the burner together with feed lines, the flame itself and the combustion chamber. In that case, the energy required for forming and maintaining the acoustic oscillation is delivered from the combustion process itself.

The acoustic relationships in a combustion chamber together with attached systems are explained in detail in a book entitled "Combustion-Driven-oscillations in Industry" by A. A. Putnam, American Elsevier Publishing Company, Inc., New York 1971, page 2. Reference should also be made to a dissertation entitled "Experimentelle und theoretische Untersuchungen der Entstehungsmechanismen selbsterregter Druckschwingungen in technischen Vormish-Verbrennungs-systemen" [Experimental and Theoretical Research into the Development Mechanisms of Self-Starting Pressure Oscillations in Technical Premix-Combustion Systems] by H. Büchner, University of Karlsruhe 1992, pages 4 and 5. A condition known as "Rayleigh criterion", which has to be fulfilled so that a stable combustion oscillation can occur, is presented and explained in each case.

A criterion which relates the period of an acoustic oscillation, the possibility of occurrence of which is discussed, to a "delay time" substantially characterizing a burner and its operation can also be derived from the Rayleigh criterion. That delay time is a period of time after which an acoustic impulse in the combustion chamber, to which the burner is attached, causes a thermal impulse during the combustion of the fuel fed through the burner. The delay time is determined relative to a stable oscillation present in the combustion chamber and to a thermal oscillation produced by the stable oscillation through the burner. In other words, the delay time is a periodic fluctuation of the transformation of energy during the combustion effected by the burner, which corresponds to a phase difference between the acoustic and the thermal oscillation. In that respect, reference should be made in particular to the dissertation of Büchner, pp. 26–29 as well as to a report entitled "Untersuchung der Anregungsmechanismen selbsterregter Verbrennungsschwingungen an einem Verbrennungssytem für Flüssigkraftstoff" [Research into the Excitation Mechanisms of Self-Starting Combustion Oscillations in a Combustion System for Liquid Fuel] by J. Herrmann, P. Zangl, S. Gleis and D. Vortmeyer, VDI reports No. 1193 (1995), pp. 251–260.

The delay time of a burner in a combustion chamber is composed of various summands, which in each case can be attributed to individual components of the system being formed of the burner, the combustion chamber and the flame. The summands which can be related to the burner and the combustion chamber are determined mainly by the geometry of the burner and the combustion chamber. A summand which can be attributed to the flame itself is substantially determined by the properties of the combustion itself. The summand itself can be broken down further into a "convective delay time", which characterizes a transport time for the transport of the reaction partners to the flame front, where the combustion starts, a "heating time", which specifies the time for heating the reaction partners to the temperature required for ignition, and a "reaction-kinetic delay time", which is determined by the course of the combustion itself. As a rule, the convective delay time clearly outweighs the other two summands.

Conventional measures for suppressing a combustion oscillation in a combustion chamber are based either on the fact that more or less empirically passive acoustic measures are used, such as choke points, resonators and/or silencers, as is seen in the above-mentioned book by Putnam, pp. 156–175, or on the fact that the feeding of the fuel is carried out with active modulation with the aim of uncoupling the energy release from acoustic oscillations in the combustion chamber. Such a measure is designated as "active instability control". For an explanation, see a paper entitled "Die 'aktive Instabilitätskontrolle', als Untersuchungsmethode f ür selbsterregte Verbrennungsinstabilitäten" [The "Active Instability Control", as Research Methods for Self-Starting Combustion Instabilities] by S. Gleis and D. Vortmeyer, in VDI Reports No. 765 (1989), pp. 645–656. In German Published, Non-Prosecuted Patent Application DE 42 41 729 A1, an actuator is described, through the use of which a mass-flow or pressure fluctuation can be imposed on a liquid flow under pressure. The actuator is proposed for use in the active control of combustion instability in liquid fuel burners and in devices for the atomization of liquids.

The conventional passive measures for suppressing combustion oscillations are used to stabilize the operation of the plant by displacing the acoustic properties of subsystems in such a way that combustion oscillations no longer occur over the entire desired operating range. Those measures require devices which have to be adapted to the respective plant in the individual case and always involve the risk that, although known unstable operating points will be stabilized, further instability will be caused under different operating conditions.

A device for reducing oscillations in combustion chambers is specified in German Published, Non-Prosecuted Patent Application DE 43 36 096 A1. In that device, a plurality of burners are disposed in the direction of flow upstream of the combustion chamber. In each case, adjacent burners are disposed in such a way as to be displaced relative to one another by a predetermined distance in the direction of flow.

In that case, the predetermined distance is selected in such a way that, during operation of the burners, the temperature fluctuations of adjacent burners spreading in the direction of flow are exactly opposite. In a cross-section relative to the direction of flow, combustion zones having a positive and a negative deviation from a mean temperature therefore lie next to one another. In that case mixing of those regions takes place in the direction of flow and thus the temperature is evened out. That is intended to prevent a combustion oscillation induced by temperature fluctuations and thus also, due to different densities, pressure fluctuations.

Active measures for suppressing combustion oscillations can only be realized in industrial plants at a high cost, in particular when a gaseous fuel is to be used, and in addition are susceptible to trouble and need maintenance. Furthermore, they merely lead to damping of the instability present in each case and are greatly restricted in their effectiveness by the decisive structural conditions of the plant in the respective individual case.

SUMMARY OF THE INVENTION

It is accordingly an object of the invention to provide a method and a device for burning fuel with air, which overcome the hereinafore-mentioned disadvantages of the heretofore-known methods and devices of this general type and which provide novel passive measures that are used at a combustion chamber having a plurality of burners and are suitable for the reliable suppression of combustion oscillations. The measures are to be capable of being used for both liquid and gaseous fuels irrespective of technical or functional details of the combustion chamber. No moving parts or components which are active in another way are to be used.

With the foregoing and other objects in view there is provided, in accordance with the invention, a method of burning fuel with air in a combustion chamber, which comprises feeding air through at least one air inlet to the combustion chamber; feeding fuel through a plurality of burners to the combustion chamber, each burner having an associated delay time corresponding to a period of time after which an acoustic impulse in the combustion chamber causes a thermal impulse during combustion of the fuel fed with the burner; and adjusting the feeding of the fuel through the burners and the feeding of the air through the air inlet in such a way that the delay times of the burners are substantially different from one another.

The invention starts from the knowledge that, in a combustion chamber as is normally used in a gas turbine and which as a rule has a plurality of burners of the same type, intensified excitation of combustion oscillations may occur by interaction of the burners. If thermal oscillations form first of all at only one burner in interaction with acoustic oscillations in the combustion chamber, that one burner likewise excites oscillations in every other burner in the combustion chamber. That effect manifests itself, for example, in the fact that in each case there are sharp transitions between operating states with and without combustion oscillations in a combustion chamber having a plurality of burners of the same type. Since combustion oscillations which occur always come from a plurality of burners, very high amplitudes will also be observed in the case of such combustion oscillations.

In order to counteract this, the invention makes provision for burners to be provided with different acoustic properties, i.e. in particular different delay times. Consequently, the burners cannot excite one another, and in addition a damping effect starting in each case from a burner working in a stable manner can always be utilized.

In accordance with another mode of the invention, an associated air inlet is allocated to each burner, the air is fed through the associated air inlet in an associated flow to the combustion chamber, and the associated flows of the burners are substantially different from one another. This ensures that the thermodynamic relationships characterizing the respective operation of the burners are certainly different from one another and the difference in the delay times among the burners is guaranteed.

In accordance with a further mode of the invention, an associated air inlet is allocated to each burner, the air is fed through the air inlet in an associated flow to the combustion chamber, the burners are constructed to be essentially identical to one another, and the associated flow is choked at each associated air inlet except for one, so that all associated flows are substantially different from one another. Alternatively, the associated flow is choked at each associated air inlet. This may be desirable in order to give the flow certain desired properties, e.g. in order to homogenize it. These refinements permit the use of burners which are essentially identical to one another and reliably ensure the requisite difference in the delay times by a simple and inexpensive additional measure.

In accordance with an added mode of the invention, an associated air inlet is allocated to each burner, the air is directed through the air inlet in an associated flow into the combustion chamber, the associated flows are geometrically similar to one another, and the burners are geometrically similar to one another but are of different sizes. This refinement is also of interest with regard to a corresponding device, since this refinement nonetheless enables a single form to be provided for the burners and enables this single form merely to be scaled differently for the manufacture of the different burners. The difference in the delay times is still guaranteed, since the delay time of a burner is not determined solely by its geometry and is therefore not invariable in scale.

In accordance with an additional mode of the invention, the fuel is fed to each burner in such a way that a mixing ratio between the fuel fed and the air fed through the associated air inlet is maintained at a preset rate for all burners. This refinement is of particular interest because, with respect to the thermal output desired overall from the combustion, it enables each burner to be operated in an optimum manner with regard to an always undesirable production of nitrous oxides. However, the refinement requires an appropriately enhanced fuel feed.

In accordance with yet another mode of the invention, alternatively, the fuel to be fed to each burner is at a preset rate for all burners. This certainly means that individual burners possibly may not be operated in an optimum manner with regard to the production of nitrous oxides, but this may be acceptable in view of the simple fuel feed.

In accordance with yet a further mode of the invention, the combustion chamber is resonant for an acoustic oscillation having a certain period, and the associated delay time of each burner lies between an integral multiple minus a quarter and the integral multiple plus a quarter of the period. This corresponds to the adherence to the criterion derived by Hermann et al. as well as by Buchner from the Rayleigh criterion between the delay time and the period of the acoustic oscillation taken into consideration. In this case, the term "integral multiple" also includes zero. It goes without saying that the delay time, by definition, cannot assume negative values. The feature that the combustion chamber is resonant for a certain acoustic oscillation is not to be interpreted as a restriction to the effect that only the combustion chamber alone must be decisive for this resonance. It goes without saying that the combustion chamber, as a rule, is part of a more or less complex complete acoustic system, with the resonance being defined with all essential parameters by the complete acoustic system.

In accordance with yet an added mode of the invention, the fuel is mixed with the air in each burner before it is burned in the combustion chamber. Combustion appropriately known as "premix combustion" is therefore used within the limits of this refinement. Premix combustion is of particular interest because it takes place at lower temperatures than diffusion combustion to be effected with simpler measures and is therefore considerably less susceptible to the production of nitrous oxides than diffusion combustion. Of importance in this connection is the fact that the invention also compensates for the thermodynamic acoustic problems of premix combustion which are mentioned at the outset.

In accordance with yet an additional mode of the invention, each refinement of the method is especially beneficial for use on a gas turbine, wherein the air is provided from a compressor, and flue gas, which develops in the combustion chamber by the fuel being burned in the air, is fed to a turbine.

With the objects of the invention in view there is also provided a device for burning fuel with air, comprising a combustion chamber for burning fuel with air in the combustion chamber; at least one air inlet for feeding the air into the combustion chamber; a plurality of burners for feeding the fuel into the combustion chamber, each of the burners having an associated delay time corresponding to a period of time after which an acoustic impulse in the combustion chamber causes a thermal impulse during a combustion of the fuel fed through the burner, the delay times of the burners differing substantially from one another; and a fuel feed for feeding the fuel to the burners.

Essential advantages of this device may be deduced from the advantages of the method according to the invention and its refinements, to which reference is hereby made. The method and its refinements will possibly require certain features in terms of a device, which can be regarded as features of refinements of the device according to the invention. The same applies to features in terms of a method, which can be deduced from the device and its refinements and are to be understood analogously as features of refinements of the method.

In accordance with another feature of the invention, the burners are geometrically different from one another.

In accordance with a further feature of the invention, the burners in the device are geometrically identical to one another, and the fuel feed is set up for feeding the fuel to the burners at respective rates which are substantially different from one another.

In accordance with an added feature of the invention, an associated air inlet is allocated to each burner, and a choke for choking a flow of the air through the associated air inlet is provided at each burner except for one, or at each burner. Such a choke may be, for example, a diaphragm disposed in front of the burner.

In accordance with an additional feature of the invention, the combustion chamber is resonant for an acoustic oscillation having a certain period, and for each burner, the associated delay time lies between an integral multiple minus a quarter and the integral multiple plus a quarter of the period. This refinement corresponds to an already-discussed refinement of the method according to the invention and all comments made in this respect analogously apply to the refinement of the device.

In accordance with a concomitant feature of the invention, the device is especially preferred for use on a gas turbine, with the combustion chamber being disposed between a compressor and a turbine of the gas turbine.

In order to place the plurality of burners in the combustion chamber, it may be noted that, if possible, an asymmetrical configuration of the burners will be preferred. The possible layout of the asymmetrical configuration in the individual case, and the criterion according to which "adequate asymmetry" can be established, will be left to the judgement of the person skilled and active in the relevant art for each individual case. The principle mainly to be taken into account in that case boils down to the fact that an acoustic oscillation is characterized as a rule by a more or less symmetrical configuration of stationary acoustic waves in the complete oscillating system. A combustion oscillation which was observed at an annular combustion chamber and was characterized by acoustic waves which ran uninterrupted around the annular combustion chamber may be referred to as an example. In that case, the wave length of the acoustic oscillations corresponded to half the average circumference of the annular combustion chamber. In order to suppress such an oscillation, it would be of advantage to avoid two-fold or four-fold symmetry in the configuration of the burners.

The invention does not demand that there must be no two burners having identical properties in the combustion chamber. The purpose of the invention can be served perfectly well with a combustion chamber to which in each case a plurality of burners of a plurality of types of burners are attached. In that connection, at a gas turbine having two silo combustion chambers of conventional type, each of which had six burners identical to one another for the combustion of heating oil, acoustic oscillations having amplitudes of 100 mbar were observed during operation at 80% of the rated load governing the structure. It was possible to remove those acoustic oscillations by exchanging two of the six burners for slightly modified burners in each silo combustion chamber. The modified burners were constructed in such a way that they received about 8% less fuel than the unaltered burners at rated load. The modified burners were used in such a way that in each case they enclosed an unaltered burner between hem. The modified configuration of the burners enabled the gas turbine to be operated up to 100% of its rated load without acoustic oscillations occurring at a noticeable level.

Other features which are considered as characteristic for the invention are set forth in the appended claims.

Although the invention is illustrated and described herein as embodied in a method and a device for burning fuel with air, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

The drawings are partly schematic and diagrammatic and are not to be interpreted as a representation of plants or plant components that are actually constructed. In order to supplement the information given with the aid of the drawing, reference may be made to the above explanation of a test that was actually carried out, the cited documents of the prior art, as well as the knowledge of a person skilled and active in the relevant art.

DESCRIPTION OF THE PREFERRED EMBODIMENTS

Figure 1:
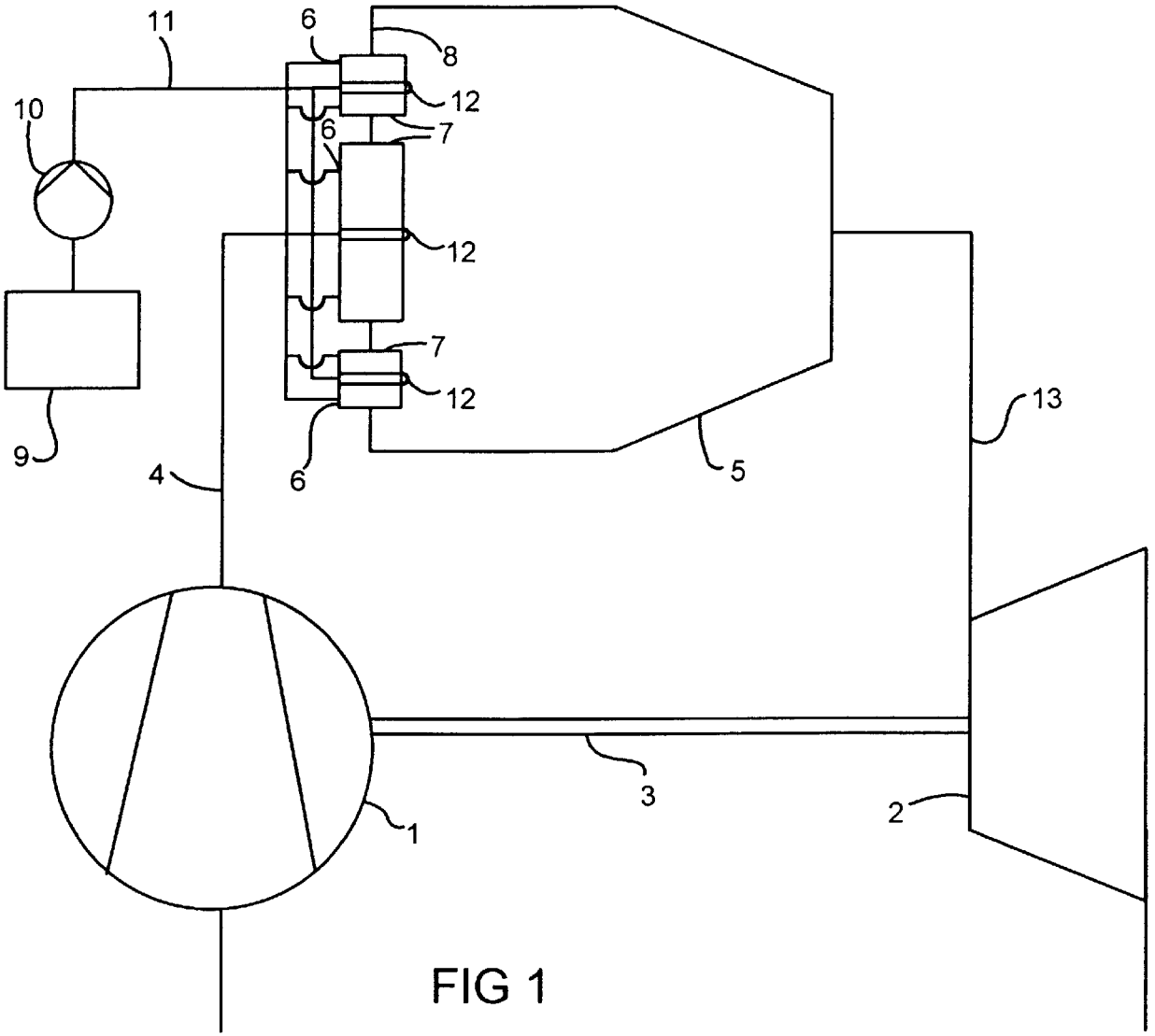
FIG. 1 is a schematic and diagrammatic view of a gas turbine and a device for burning a fuel with air.

Referring now in detail to the figures of the drawings, in which components corresponding to one another have the same reference numeral, and first, particularly, to FIG. 1 thereof, there is seen a gas turbine having a compressor 1 and a turbine 2 which drives the compressor 1 through a shaft 3. Compressed air passes from the compressor 1 through an air line 4 to a combustion chamber 5 and enters the latter through air inlets 6, each of which is allocated to a burner 7. Each burner 7 is disposed in a rear wall 8 of the combustion chamber 5. The burners 7 are supplied with fuel from a tank 9 through a pump 10 and a fuel line 11, which branches upstream of the burners 7. This fuel burns in the combustion chamber 5 with the air fed through the air line 4.

The combustion chamber 5 is a structure capable of acoustic oscillations and can be considered, if need be, as an integral part of a complete system which is capable of acoustic oscillations. The system includes, for example, the combustion chamber 5, a flue-gas line 13 leading from the combustion chamber 5 to the turbine 2 and, if need be, the air line 4 and the fuel line 11. Acoustic oscillations in the combustion chamber 5, which oscillates on its own or as an integral part of such a complete system, may be excited and maintained by fluctuations during the combustion of the fuel. In such a case, the term combustion oscillations is used. Such combustion oscillations may become so great that the combustion chamber 5 and other parts of the gas turbine may be damaged.

In order to prevent such combustion oscillations and in particular to rule out the possibility of a plurality of the burners 7 interacting so as to excite such a combustion oscillation, the burners 7 are constructed to be different from one another. The result of this is that not all of the burners 7 have the same relevant properties and that in particular delay times characterizing the respective combustion process are different from one another. In this way, the possibility of the burners 7 collectively exciting a combustion oscillation is at any rate ruled out in the configuration according to FIG. 1.

Information with regard to preferred modes of operation of the burners 7 has already been given. All of this information is of interest for the exemplary embodiment outlined with reference to FIG. 1. In particular, it is possible to apportion the fuel to the burners 7 according to certain preferred setpoint inputs. In this case, the aim in particular may be for each burner 7 to work in such a way that the ratio of the air fed through its associated air inlet 6 to the fuel directed through its associated nozzle 12 is at a preset rate for all of the burners. Such a mode of operation will be preferred in order to keep the production of nitrous oxides in the combustion chamber 5 as low as possible.

The burners 7 in FIG. 1 are shown as so-called diffusion burners, since they inject the fuel directly into the combustion chamber 5. In this case, the fuel can only mix with the fed air in the combustion chamber 5 which, as known from experience, takes place by diffusion. Diffusion burners have a simple construction and are relatively straightforward to operate. However, with regard to the production of nitrous oxides, they are inferior to the more complicated premix burners, which will be explained with reference to FIG. 2.

Figure 2:
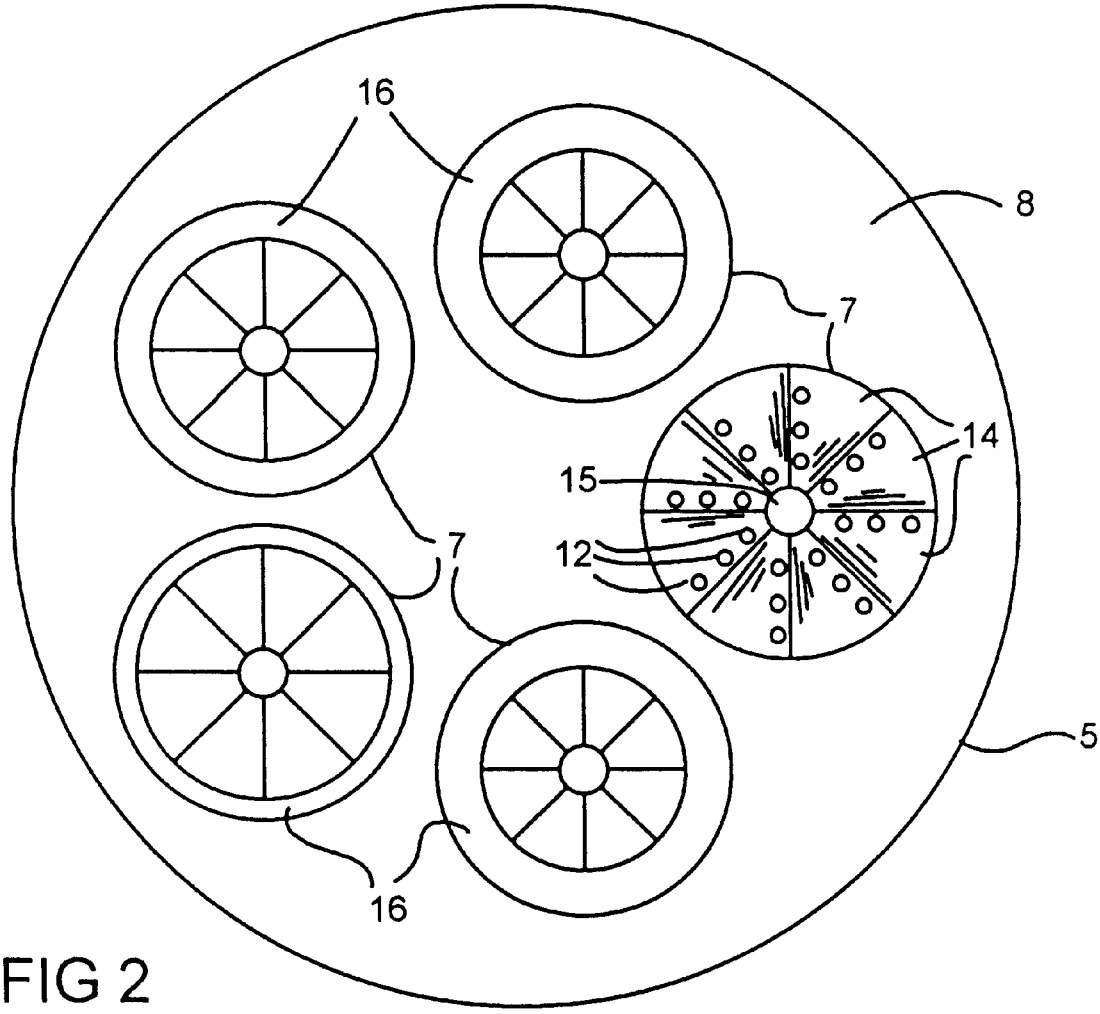
FIG. 2 is a plan view of a combustion chamber having a plurality of burners.

FIG. 2 shows a plan view of the rear wall 8 of a combustion chamber 5, as viewed in the direction in which the air flows to the combustion chamber 5. Fitted into the rear wall 8 are five burners 7, which are all constructed to be essentially identical to one another. Each burner 7 has a number of swirl blades 14, which impose a swirl on the air that passes through it. Such a swirl is of advantage for the combustion itself and for the intimate mixing of the fuel with the air. The nozzles 12 are provided in the swirl blades 14. The fuel passes from the nozzles 12 into the air before the latter flows into the combustion chamber 5 and the fuel can ignite. Accordingly, the burners 7 shown in FIG. 2 are so-called "premix burners". These premix burners of course have a more complicated construction than diffusion burners and are also clearly more elaborate with regard to their operation than the diffusion burners, but have substantial advantages over the latter with regard to the production of nitrous oxides. A premix burner burns a mixture of fuel and air having a defined composition, so that considerably more sensitive control of the combustion is possible than in the case of a diffusion burner, where the operation of mixing fuel and air virtually cannot be controlled. The combustion in the case of a premix burner also takes place at significantly lower maximum temperatures than in the case of a diffusion burner, a factor which is advantageous for avoiding the production of nitrous oxides. At each burner 7, the blades 14 encircle a hub 15. The hub 15 can serve to direct fuel to the nozzles 12.

In the exemplary embodiment according to FIG. 2, diaphragms or chokes 16 are attached in front of four of the five burners 7. Each of the diaphragms 16 partly covers the corresponding swirl blades 14 and therefore acts as a choke for the air flow entering the burner 7. The result of this is that the decisive operating parameters of all of the burners 7 are different from one another, so that interaction of the burners 7 for exciting combustion oscillations in the combustion chamber 5 is ruled out. The comments made with respect to preferred refinements of the invention also apply to the exemplary embodiment according to FIG. 2.

Figure 3:
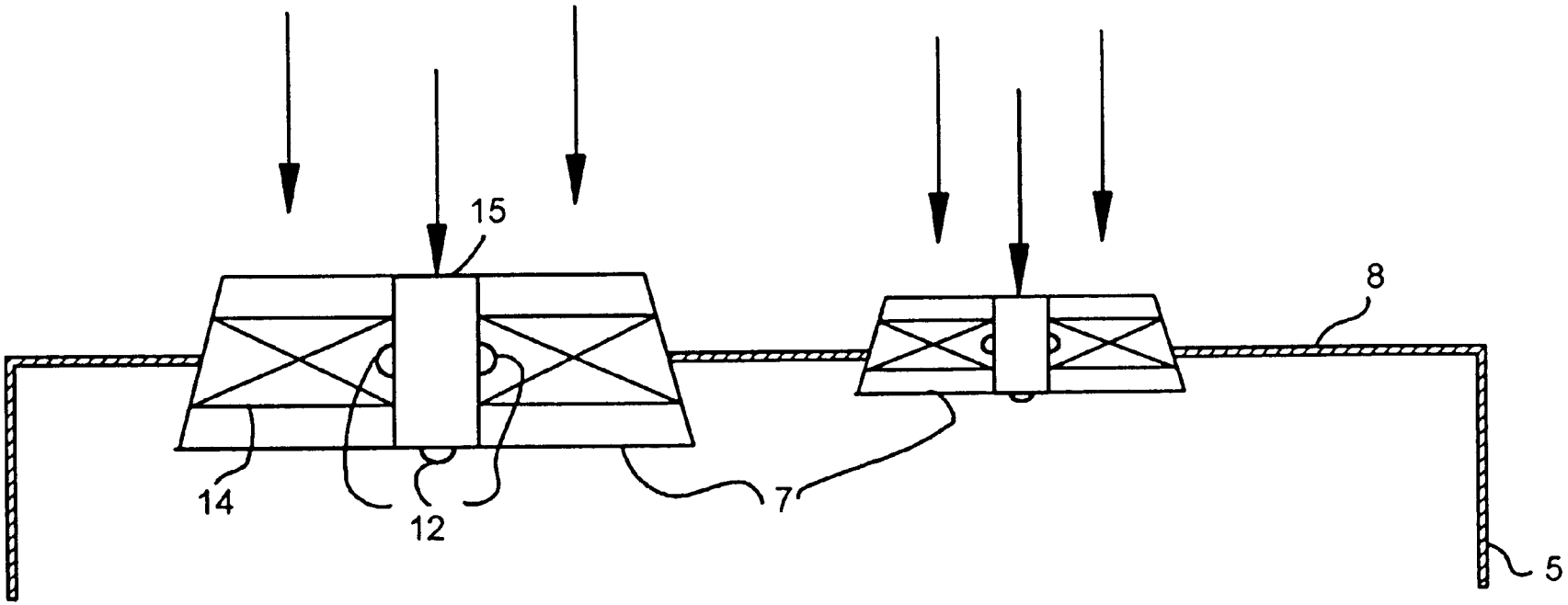
FIG. 3 is a cross-sectional view through a combustion chamber having a plurality of burners.

FIG. 3 shows a longitudinal section through a combustion chamber 5 together with its rear wall 8 and two burners 7. The burners 7 are again configured as premix burners. Each burner 7 has three nozzles 12 for feeding fuel, which are all disposed at the hub 15. The fuel passes between the swirl blades 14 from two of these nozzles, so that it is mixed with the air flowing through. One nozzle 12 directly faces the interior of the combustion chamber 5. This nozzle 12 forms a so-called "pilot flame", in which combustion in the manner of a diffusion burner takes place. This pilot flame serves to stabilize the combustion of the air/fuel mixture produced between the swirl blades 14 that normally has a distinct excess of oxygen. This enables the production of heat by the burners 7 to be controlled within wide limits.

The two premix burners are geometrically similar to one another, i.e. they differ only in their size but not in their proportions. This also results in a difference in the relevant operating parameters. That difference is utilized in order to rule out the possibility of these burners 7 interacting to excite a combustion oscillation in the combustion chamber 5.

We claim:

1. In a method of burning fuel with air in a combustion chamber, the improvement which comprises:

feeding air through at least one air inlet to the combustion chamber;

feeding fuel through a plurality of burners to the combustion chamber, each burner having an associated delay time corresponding to a period of time after which an acoustic impulse in the combustion chamber causes a thermal impulse during combustion of the fuel fed with the burner; and adjusting the feeding of the fuel through the burners and the feeding of the air through the air inlet in such a way that the delay times of the burners are substantially different from one another.

2. The method according to claim 1, which comprises:

a) allocating an associated air inlet to each burner, and feeding the air in an associated flow through the air inlet to the combustion chamber; and b) setting the associated flows of the burners to be substantially different from one another.

3. The method according to claim 1, which comprises:

a) constructing the burners to be essentially identical to one another;

b) allocating an associated air inlet to each burner, and feeding the air in an associated flow through the air inlet to the combustion chamber; and c) choking the associated flow at each associated air inlet except for one, so that all of the associated flows are substantially different from one another.

4. The method according to claim 1, which comprises:

a) constructing the burners to be essentially identical to one another;

b) allocating an associated air inlet to each burner, and feeding the air in an associated flow through the air inlet to the combustion chamber; and c) choking the associated flow at each associated air inlet, so that the associated flows are different from one another.

5. The method according to claim 1, which comprises:

a) constructing the burners to be geometrically similar to one another but of different sizes;

b) allocating an associated air inlet to each burner, and directing the air in an associated flow through the air inlet into the combustion chamber, so that the associated flows are geometrically similar to one another.

6. The method according to claim 1, which comprises feeding the fuel to each burner in such a way that a mixing ratio between the fuel fed and the air fed through the associated air inlet is maintained at a preset rate for all of the burners.

7. The method according to claim 1, which comprises feeding the fuel to each burner at a preset rate for all of the burners.

8. The method according to claim 1, wherein the combustion chamber is resonant for an acoustic oscillation having a certain period, and setting the associated delay time for each burner between an integral multiple minus a quarter and the integral multiple plus a quarter of the period.

9. The method according to claim 1, which comprises mixing the fuel with the air in each burner before it is burned in the combustion chamber.

10. The method according to claim 1, which comprises supplying the air from a compressor, and feeding flue gas developing in the combustion chamber by burning the fuel in the air, to a turbine.

11. A device for burning fuel with air, comprising:

a) a combustion chamber for burning fuel with air in said combustion chamber;

b) at least one air inlet for feeding the air into said combustion chamber;

c) a plurality of burners for feeding the fuel into said combustion chamber, each of said burners having an associated delay time corresponding to a period of time after which an acoustic impulse in said combustion chamber causes a thermal impulse during a combustion of the fuel fed through said burner, said delay times of said burners differing substantially from one another; and d) a fuel feed for feeding the fuel to said burners.

12. The device according to claim 11, wherein said burners are geometrically different from one another.

13. The device according to claim 11, wherein said burners are geometrically identical to one another, and said fuel feed feeds the fuel to said burners at respective rates differing substantially from one another.

14. The device according to claim 11, wherein said at least one air inlet includes associated air inlets each allocated to a respective one of said burners, and chokes each disposed at a respective one of said burners except one, for choking a flow of the air through said associated air inlet.

15. The device according to claim 11, wherein said at least one air inlet includes associated air inlets each allocated to a respective one of said burners, and chokes each disposed at a respective one of said burners for choking a flow of the air through said associated air inlet.

16. The device according to claim 11, wherein said combustion chamber is resonant for an acoustic oscillation having a certain period, and said associated delay time for each of said burners lies between an integral multiple minus a quarter and the integral multiple plus a quarter of the period.

17. A gas turbine, comprising:

a compressor;

a turbine; and a device for burning fuel with air, the device including:

a) a combustion chamber disposed between said compressor and said turbine for burning fuel with air in said combustion chamber;

b) at least one air inlet for feeding the air from said compressor into said combustion chamber;

c) a plurality of burners for feeding the fuel into said combustion chamber, each of said burners having an associated delay time corresponding to a period of time after which an acoustic impulse in said combustion chamber causes a thermal impulse during a combustion of the fuel fed through said burner, said delay times of said burners differing substantially from one another; and d) a fuel feed for feeding the fuel to said burners.

* * * * *